US010245742B2

(12) United States Patent
Foreman et al.

(10) Patent No.: US 10,245,742 B2
(45) Date of Patent: Apr. 2, 2019

(54) SIDE LOADING PENDULUM SLICER

(71) Applicant: J.E. Grote Company, Inc., Columbus, OH (US)

(72) Inventors: John Timothy Foreman, Delaware, OH (US); John B. Gorun, Worthington, OH (US)

(73) Assignee: J.E. Grote Company, Inc., Columbus, OH (US)

( * ) Notice: Subject to any disclaimer, the term of this patent is extended or adjusted under 35 U.S.C. 154(b) by 351 days.

(21) Appl. No.: 14/164,736

(22) Filed: Jan. 27, 2014

(65) Prior Publication Data

US 2015/0209972 A1 Jul. 30, 2015

(51) Int. Cl.
*B26D 7/06* (2006.01)
*B26D 7/32* (2006.01)

(52) U.S. Cl.
CPC ..... *B26D 7/0625* (2013.01); *B26D 2210/02* (2013.01); *Y10S 83/932* (2013.01); *Y10T 83/654* (2015.04)

(58) Field of Classification Search
CPC . Y10S 83/932; B26D 2210/02; B26D 7/0616; B26D 7/0641; B26D 7/0625; B26D 7/32; B26D 7/06; Y10T 83/6547; Y10T 83/6548; Y10T 83/6492; Y10T 83/6508; Y10T 83/651; Y10T 83/6512; Y10T 83/141; Y10T 83/145; Y10T 83/654
USPC ..... 99/537
See application file for complete search history.

(56) References Cited

U.S. PATENT DOCUMENTS 3,760,715 A 9/1973 Grote et al.
4,051,757 A * 10/1977 Reifenhauser ..... B26D 3/18 83/404.3
4,230,007 A 10/1980 Grote et al.
4,436,012 A * 3/1984 Hochanadel ..... B26D 1/46 83/409.2
4,543,864 A * 10/1985 Hochanadel ..... B26D 7/32 83/155.1
5,038,649 A * 8/1991 Hoaglin ..... B26D 3/185 241/291
5,230,267 A * 7/1993 Abler ..... B26D 7/32 426/518
5,566,600 A 10/1996 Johnson et al.
5,784,936 A * 7/1998 King ..... B26D 7/32 83/145

(Continued)

FOREIGN PATENT DOCUMENTS

CN 201039722 3/2008
EP 1749445 A1 2/2007

*Primary Examiner* — Evan H MacFarlane
(74) *Attorney, Agent, or Firm* — Jason H. Foster; Kremblas & Foster

(57) ABSTRACT

A side-loading pendulum slicer for slicing short and/or oddly-shaped food products. The pendulum slicer has an aperture in the upstream side of the product holder through which food products are injected. A loading conveyor holds large numbers of food products that are sequentially and individually loaded onto an injecting conveyor that injects the food products through the aperture and into the product holder. A weight that is raised above the aperture is lowered onto the food product to compress the food product against a thickness tray while the product holder reciprocates through a blade adjacent the thickness tray. Slices are removed from the food product and conveyed away for use.

6 Claims, 6 Drawing Sheets

(56) References Cited

U.S. PATENT DOCUMENTS

| | | | | | |
|---|---|---|---|---|---|
| 5,787,776 | A * | 8/1998 | Nishimoto | B26D 7/32 | 83/355 |
| 5,918,538 | A * | 7/1999 | Rodriguez | A21C 15/04 | 83/155 |
| 5,983,769 | A * | 11/1999 | Schneider | A47J 43/255 | 241/101.4 |
| 6,044,739 | A * | 4/2000 | Abler | B26D 3/28 | 426/518 |
| 6,044,741 | A * | 4/2000 | Sapp | B26D 3/28 | 83/419 |
| 6,045,071 | A * | 4/2000 | Emsens | A22C 17/02 | 241/101.4 |
| 7,430,947 | B2 * | 10/2008 | Julian | B26D 1/26 | 83/207 |
| 7,658,135 | B2 * | 2/2010 | Grasselli | A22C 17/0033 | 83/707 |
| 2012/0210680 | A1 * | 8/2012 | Grasselli | A22C 17/0033 | 53/517 |

* cited by examiner

SIDE LOADING PENDULUM SLICER

CROSS-REFERENCES TO RELATED APPLICATIONS (Not Applicable)

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to food slicing machines, and more specifically to machines that slice food products by reciprocating the food products through a path that includes a blade.

In conventional food slicing machines, a workpiece-retaining carriage is driven for the purpose of reciprocating a food product workpiece, such as a cheese or processed meat log, through a cutter. The carriage is reciprocated through a path that causes the end of the food product workpiece to pass through a slicing blade. The food product workpiece contained in the carriage is thereby cut, forming a slice that falls downwardly due to gravity. The slice can be dropped onto a conveyor belt beneath the machine, or other substrates as the substrates are conveyed beneath the machine. U.S. Pat. No. 3,760,715 and U.S. Pat. No. 4,230,007 disclose food slicing machines, and are incorporated herein by reference.

The workpiece-retaining carriage is linked to a drive mechanism, which can include pivoting cranks connected to rotary motors (hydraulic, pneumatic, electric, etc.) that rotate a belt or chain around a pulley or gear that is connected to the carriage. Alternatively, linear prime movers, such as hydraulic or pneumatic rams can be used to drive the carriage. Drive mechanisms are described in U.S. Pat. No. 4,436,012, which is incorporated herein by reference.

A prior art reciprocating slicing machine, as described in U.S. Pat. No. 6,044,741, which is incorporated herein by reference, teaches to slice food products using a continuous blade that extends around a pair of pulleys and is driven in the manner of a band saw. A motor drives one pulley and a pulley on the opposite side of the machine serves as an idler pulley. Between the pulleys, the blade extends through a slot in a blade guide that mounts to the machine's frame. The blade guide disposes the blade a predetermined distance from an adjustable thickness tray, and this distance affects the thickness of each slice because the lower end of the food log slides against the thickness tray. After each slice is formed and the slice falls away, the food product workpiece is driven back across the blade by the carriage with the lower end of the workpiece supported by the blade. Once the workpiece reaches the sharp edge of the blade, it drops down onto the thickness tray so that another slice can be formed during the next stroke through the blade. The operation of the slicing machine is thus cyclical, with a cutting stroke during the first half of the cycle and a return stroke during the second half of the cycle.

The workpiece retaining carriages of conventional "pendulum slicers", as the above-referenced reciprocating machines are typically called, are loaded with food products from the top of the workpiece-retaining carriage. Operators simply place a food log in the open top of each substantially cylindrical carriage as the food product previously loaded is being removed by slicing at the lower end, but before the previously loaded log is fully removed by slicing. Therefore, the weight of food product above the thickness tray forces the lower end of the log downwardly onto the thickness tray that is spaced from the blade to determine the slice thickness. This weight maintains consistency in slice thickness.

Many food slicing processes leave an end cap, which is a relatively thick "heel" of a food log that is not sliced for various reasons. End caps are typically significantly thicker than slices of the same food product, and are not successfully sliced in pendulum slicers. Part of the reason end caps are not sliced in pendulum slicers is because they are often dome-shaped, which makes them difficult to stack in order for sufficient weigh to be applied to the lowest end cap. Furthermore, because carriages are tall, top loading of multiple end caps is likely to result in orientations other than the desired orientation which the domed surface faces upwardly. End caps are typically either sliced inefficiently with low safety by hand or wasted due to inefficiencies in conventional machines for slicing end caps.

Therefore, the need exists for a food slicing machine that can slice end caps efficiently so that the food product therein is not wasted.

BRIEF SUMMARY OF THE INVENTION

A food product slicer according to the invention has a product holder defined by a substantially cylindrical sidewall with a barrel formed therethrough. In an operable position, the food product slicer has a lower end with a downwardly-facing opening mounted above a blade disposed adjacent a thickness tray. A pivot is mounted between a frame and an upper end of the sidewall to permit the product holder to reciprocate. A product holder drive system is drivingly linked to the product holder for driving the product holder cyclically through a path about the pivot. The product holder's lower end passes, in an operable position, above the blade while the downwardly-facing opening faces the thickness tray. An aperture is formed in the sidewall adjacent the lower end of the product holder, and the aperture is spaced from the downwardly-facing opening and has a size of at least about one inch by about three inches.

A weight is disposed within the barrel of the product holder adjacent the aperture for bearing downwardly toward the downwardly-facing opening against a food product. The weight thus clamps the food product between the weight and the thickness tray. A prime mover drivingly linked to the weight can move the weight upwardly away from the downwardly-facing opening.

A preferred food product slicer has a first conveyor disposed upstream of the aperture, a second conveyor disposed upstream of the first conveyor, and a third conveyor disposed downstream of the aperture. A downstream end of the second conveyor is disposed, in an operable position, above an upstream end of the first conveyor, and a downstream end of the first conveyor is disposed adjacent the aperture during at least a portion of the path. This permits food products to be conveyed from the second to the first conveyor, and then from the first conveyor into the aperture. In a particularly preferred embodiment, the food product slicer has a fourth conveyor disposed beneath the weight to receive slices of food product, and the fourth conveyor is actuated by a computer to convey slices in a first direction or in an opposite, second direction.

Figure 1:
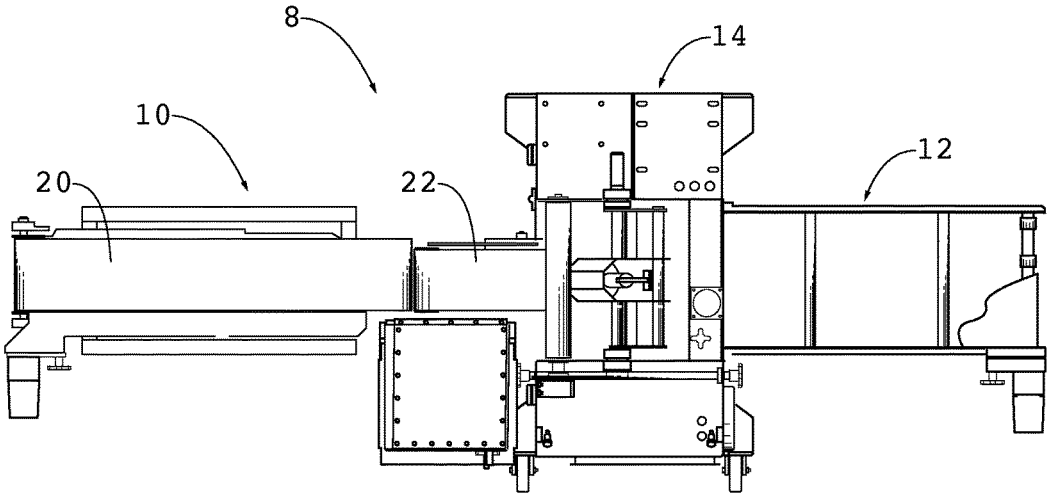
FIG. 1 is a top view illustrating a preferred embodiment of the present apparatus.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Figure 2:
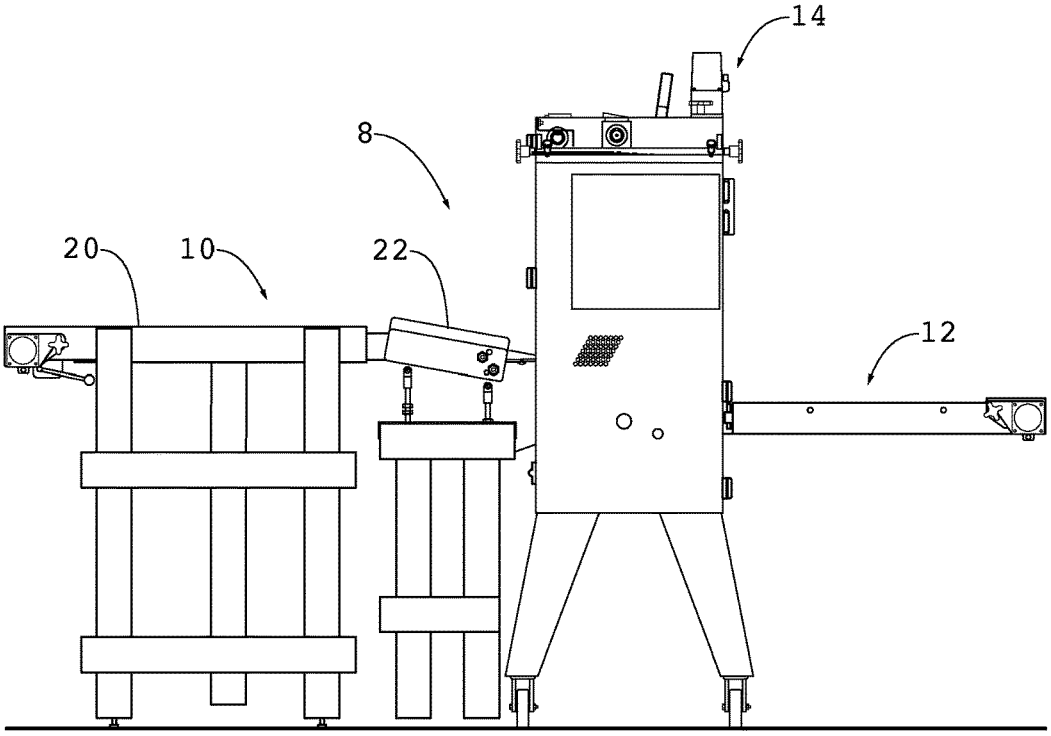
FIG. 2 is a side view illustrating the embodiment of FIG. 1.

As shown in FIGS. 1 and 2, the apparatus 8 includes an infeed 10, which is preferably a conveyor belt apparatus, and an outfeed 12, which is preferably a conveyor belt apparatus. A central housing 14 contains an apparatus for slicing food products, which is preferably a pendulum slicing apparatus and is referred to herein also as the food slicing mechanism 40. The infeed 10 transports food products resting on the upper surface thereof from near an upstream end of the apparatus 8, which is at the left end of the apparatus 8 in the configuration illustrated in FIGS. 1 and 2, toward a downstream end, which is at the right end of the apparatus 8 in the configuration illustrated in FIGS. 1 and 2. Of course, although conveyor belts are described herein, the person having ordinary skill will understand that any infeed or outfeed apparatus will suffice as long as it meets the purposes herein described.

In a preferred embodiment, a human or an apparatus (for example another conveying apparatus, not shown) deposits food products on the infeed 10, and the food products are transported by the infeed 10 toward and into the central housing 14 for slicing. The sliced food products exit the central housing 14 on the outfeed 12, and the slices are subsequently acted upon in a conventional manner, such as by being further processed by humans or machines, for example by packaging the slices. Despite this example of further processing, the invention is not limited to the type of processing that occurs subsequently.

The preferred outfeed 12 is a conventional conveyor belt made of a flexible sheet, multiple rigid and hinged pieces, or flexible strips or bands, all wound around rollers rotatably mounted to bearings on frame structures and driven by a prime mover. The preferred infeed 10 includes a loading conveyor 20 and an injecting conveyor 22, each of which is preferably a conventional conveyor belt made of a flexible sheet, multiple rigid and hinged pieces, or flexible strips, all wound around rollers rotatably mounted to bearings on frame structures and driven by a prime mover.

A human or an apparatus, such as another conveyor, deposits food products 26 on the loading conveyor 20, and these food products 26 are preferably aligned on the conveyor in series, such as in a single file row, or parallel rows of two or three across extending from the upstream to the downstream end of the loading conveyor 20. The injecting conveyor 22 preferably only supports one row of food product at a time, which it injects into the slicing mechanism 40 at high speed, as described in more detail below. If there are two or more food products on the injecting conveyor 22 at a time, they are aligned in parallel across the injecting conveyor 22.

Figure 3:
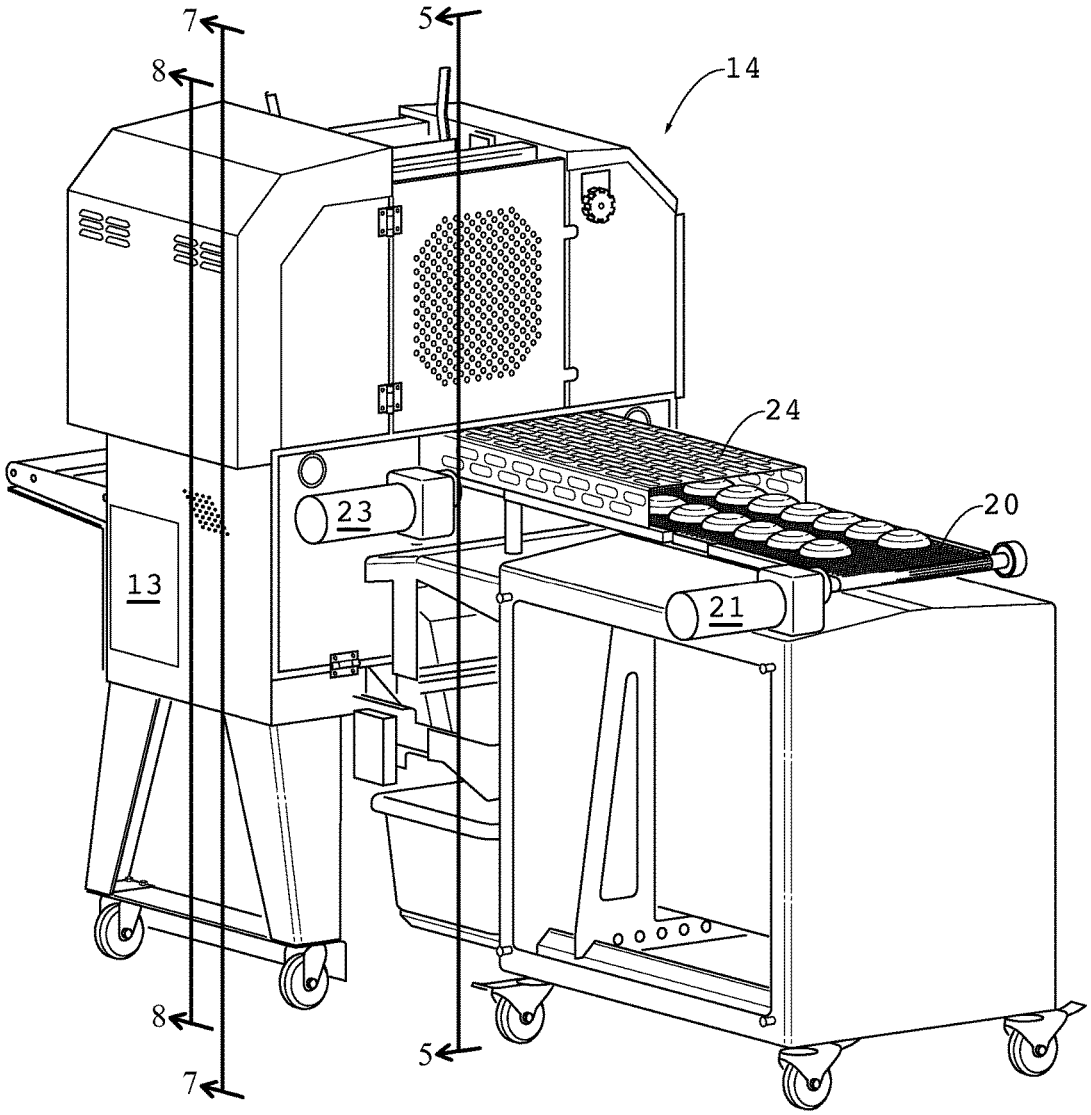
FIG. 3 is a view in perspective illustrating an embodiment of the present apparatus.

The loading conveyor 20 is shown in FIG. 3 with a guard 24 covering the conveyor and extending to attachment to the injecting conveyor's 22 frame. The guard 24 is intended to prevent a human user from extending his or her hand into the slicing mechanism in the central housing 14. The guard 24 and other safety equipment are removed from the apparatus 8 in some illustrations for the sake of disclosing the underlying structures. Of course, there may be environments in which such safety equipment is not used, but preferably the safety equipment, or something similar, is used on the apparatus 8.

Figure 4:
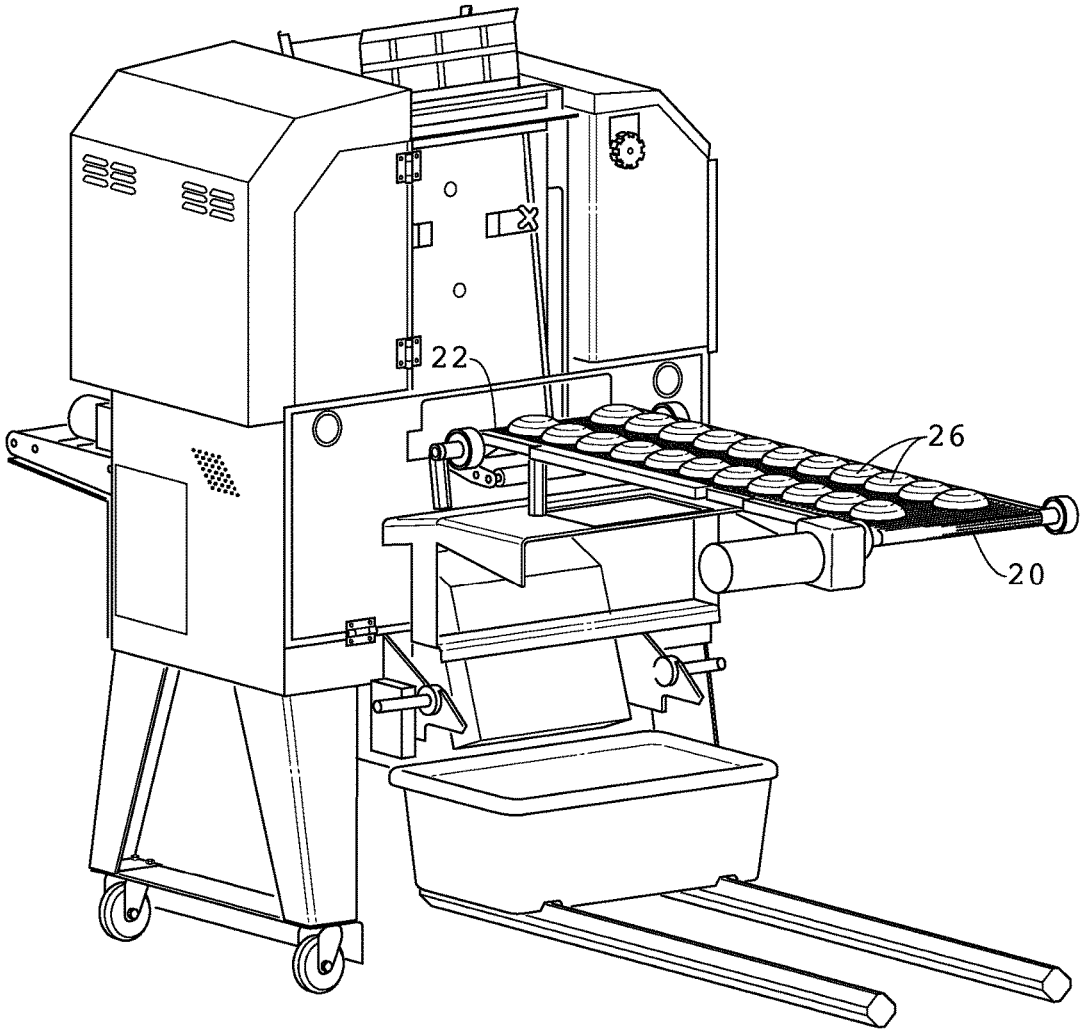
FIG. 4 is a view in perspective illustrating the embodiment of FIG. 3 with several components removed for greater visibility.
Figure 5:
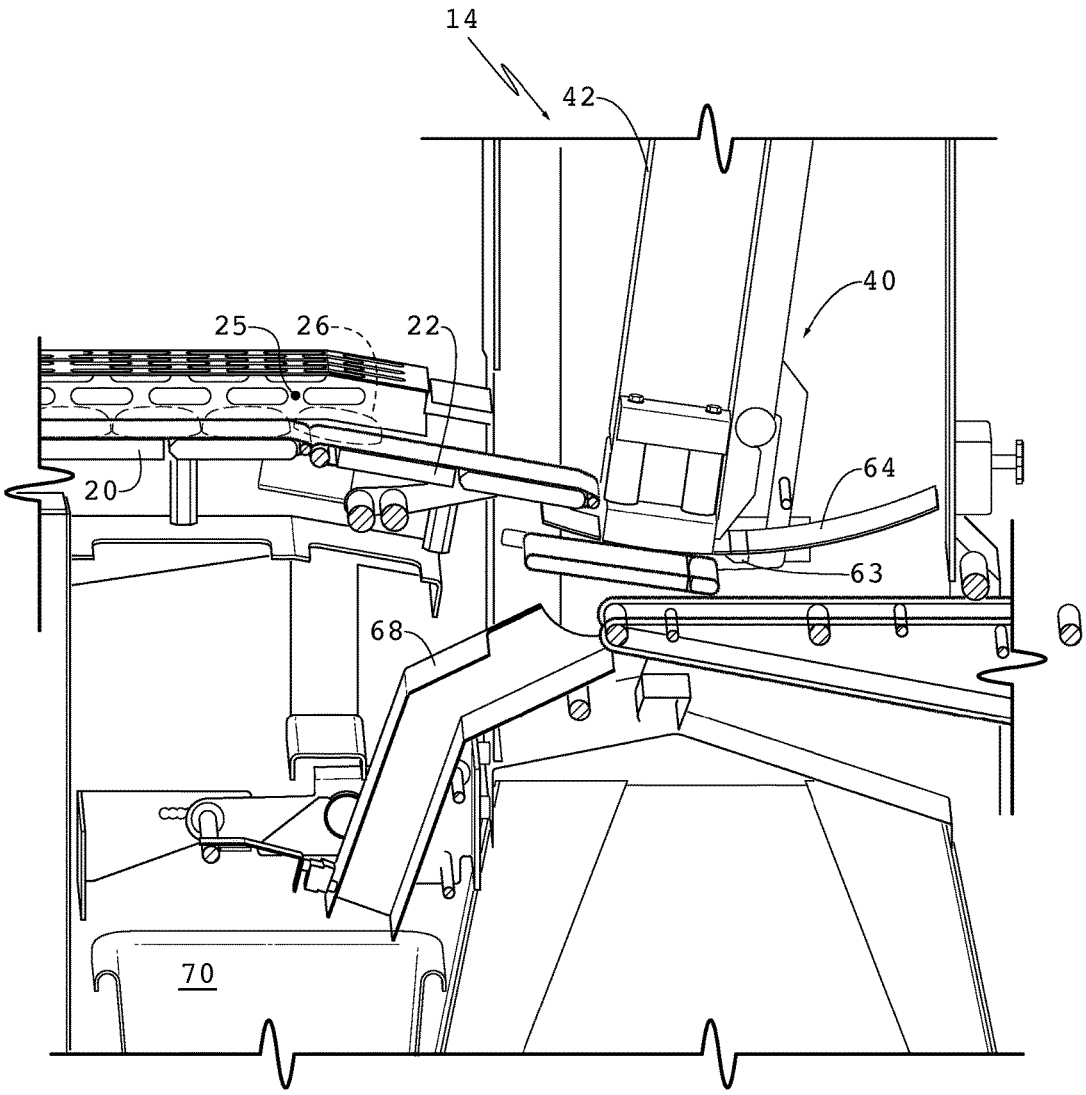
FIG. 5 is a side view in section illustrating the embodiment of FIG. 3 through the lines 5-5.

As shown in FIG. 4, the guard 24 is removed, and the food products 26 are shown after being deposited on the loading conveyor 20. The upstream end of the injecting conveyor 22 extends from below the downstream end of the loading conveyor 20 to the upstream end of the central housing 14. Thus, food products can be conveyed from the loading conveyor 20 onto the injecting conveyor 22. A food product 26 is shown in FIG. 5 bridging over from the loading conveyor 20 to the injecting conveyor 22. The downstream end of the injecting conveyor 22 extends through an opening formed in the outer wall of the central housing 14 (shown in FIG. 5).

In a preferred embodiment, the prime movers 21 and 23, which are preferably electric motors, drive the conveyors 20 and 22, respectively, and are controlled by a central computer 13 (see FIG. 3) in the central housing 14. A sensor 25 (FIG. 5) is mounted at the end of the loading conveyor 20 to detect the location of a food product 26 at the downstream end of the loading conveyor 20 and signals the computer 13 of its presence in this location. The sensor 25 can be an electronic, light-sensing device, a laser sensor, a proximity sensor, an infrared sensor, a video camera combined with specialized software to analyze the presence of the product, or any other sensor to detect the presence of the product. Thus, when a food product 26 is at the downstream end of the loading conveyor 20, the computer detects it and halts the loading conveyor's 20 prime mover 21 so that the food product is ready to load onto the injecting conveyor 22 when needed.

When the injecting conveyor 22 does not support food product, the loading conveyor 20 is advanced at its normal speed to convey the food product 26 onto the injecting conveyor 22 in preparation for the next call for a food product to be injected into the slicing mechanism. At the same time, the injecting conveyor 22 is advanced by the prime mover 23 at a speed substantially higher than the speed of the loading conveyor 20 in order to transport the food product downstream more rapidly than the food product is advanced on the loading conveyor 20, thereby creating a large gap between the food product on the injecting conveyor 22 and the food product on the loading conveyor 20. Once the most downstream food product is on the injecting conveyor 22, and, as detected by the sensor 25, the next most downstream food product reaches the downstream end of the loading conveyor 20, the loading conveyor 20 is halted by the computer 13. The injecting conveyor 22 may position the food product thereon at a location on the injecting conveyor 22 farther downstream by moving independently of the loading conveyor 20. The injecting conveyor 22 is now loaded with a single food product (or a pair or trio, etc. of laterally aligned food products) for injection into the slicing mechanism, which can occur at this time. The process of loading the injecting conveyor 22 is repeated after each food product is injected into the slicing mechanism 40, in order that the injecting conveyor 22 always has a food product on its upper surface in preparation for injection.

The slicing mechanism 40 is shown in FIG. 5 with the product holder 42 reciprocatingly mounted to the central housing's 14 frame by a pivot, such as conventional bearings, near the top of the product holder 42. The product holder preferably is a substantially cylindrical, tubular body with a barrel extending longitudinally therethrough from top to bottom, and has an open lower end facing downwardly and an open top end facing upwardly. A conventional drive mechanism in the central housing 14 is linked to the product holder 42 to drive the lower end of the product holder 42 in cyclical movement to the left and right as oriented in FIG. 5. The computer 13 controls the product holder 42 drive mechanism in a conventional manner.

Figure 6:
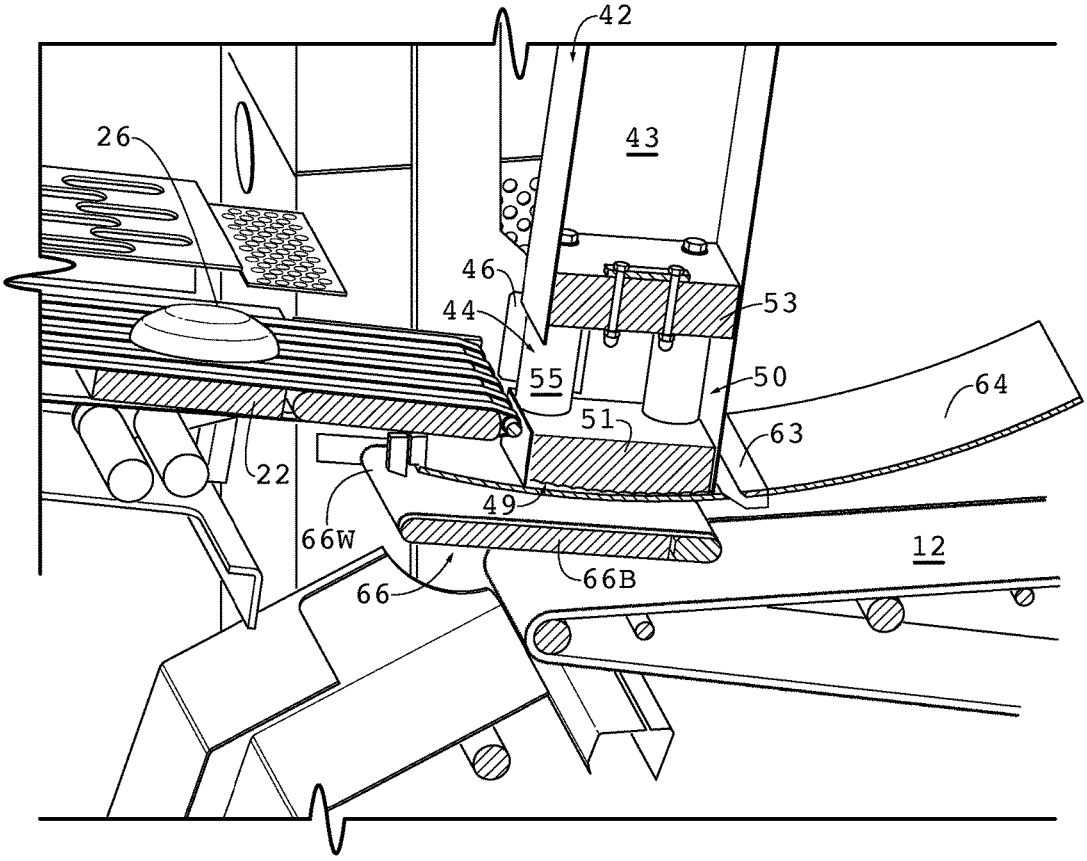

A separate drive mechanism in the central housing 14 drives one of the two pulleys 60 and 61 (see FIG. 7) around which the flexible blade 62 extends, and the other pulley is an idler pulley, as is conventional in band blade systems. A blade guide 63 (FIGS. 5 and 6) is mounted in the thickness tray 64 in a conventional manner with the sharp, upstream edge of the blade 62 spaced above the top surface of the thickness tray 64 a distance substantially equal to the desired thickness of the slice of food product. A slot is formed in the thickness tray 64 just upstream of the blade guide 63 to allow the slice that is formed at the sharpened blade edge to fall downwardly onto the substrate 66 (FIG. 6). Thus, upon rotation of the driven pulley, the blade 62 is driven through the blade guide 63, and the lower end of a food product passes through the blade to form one or more slices that drop onto the substrate 66. The substrate is mounted to move in tandem with the product holder 42, such as by attaching to the product holder 42, or to the same frame to which the product holder 42 is mounted. In any case, the substrate 66 does not move relative to the product holder 42, and thus reciprocates beneath the lower end of the product holder 42.

Figure 7:
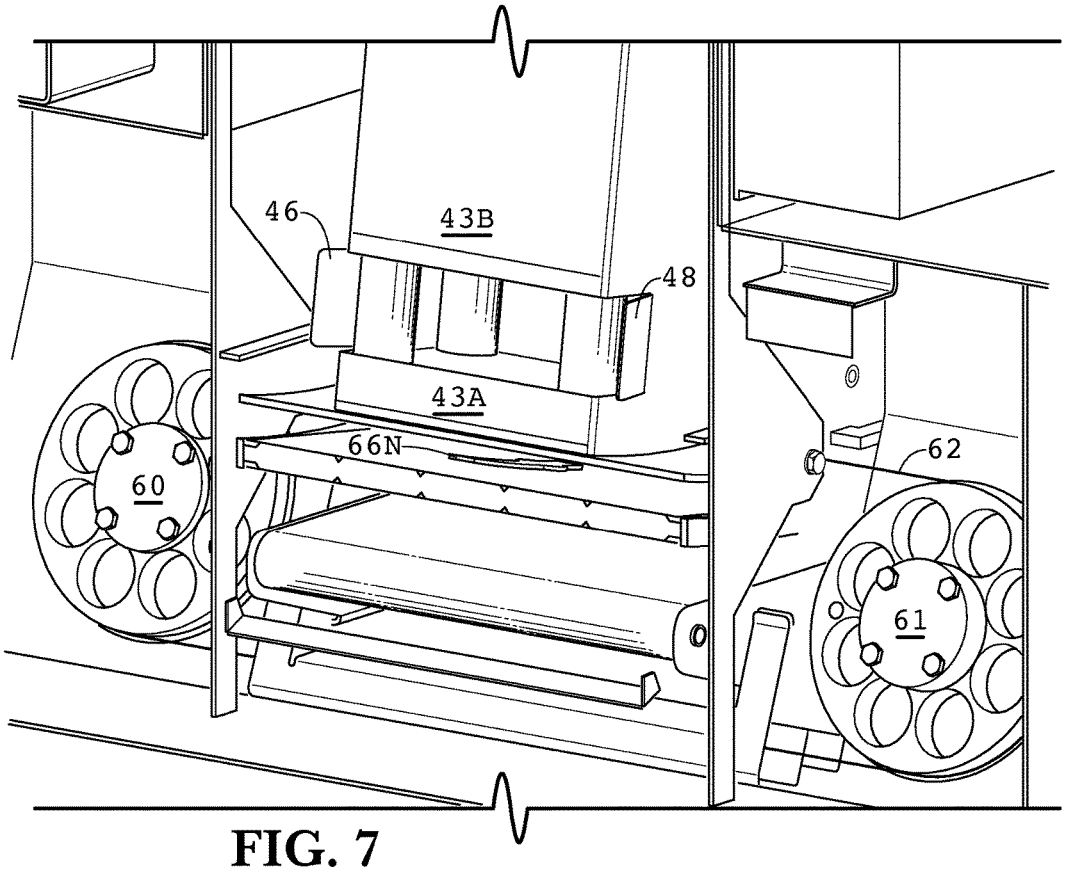
FIG. 7 is a section view in perspective illustrating the embodiment of FIG. 3 through the line 7-7.

The preferred substrate 66 is a passive conveyor, including a flexible sheet material, such as the wire belt 66*w*, wrapped in a continuous loop around a low friction, rigid material forming the base 66*b* (FIG. 6). There is no substantial resistance to rotation of the wire belt 66*w* around the base 66*b*, but the belt 66*w* does not rotate unless a force is applied thereto, as by the nose bar 66*n* (FIG. 7). The nose bar 66*n* attaches to the frame and remains immobile so that as the substrate 66 reciprocates toward and away from the nose bar 66*n*, the tip of the nose bar 66*n* rests upon the upper surface of the belt 66*w*. During the cutting stroke of the cycle, the nose bar 66*n* slides across the belt 66*w* due to the angle the nose bar 66*n* makes with the belt 66*w*. However, during the return, non-cutting stroke, the tip of the nose bar 66*n* catches the belt 66*w* and prevents the belt 66*w* from moving relative to the nose bar 66*n*. Because the nose bar holds the belt in place, as the base 66*b* moves with the product holder 42, the belt 66*w* revolves around the base 66*b*, effectively conveying the slice just formed off of the belt 66*w*. Thus, during each slicing stroke, the belt 66*w* does not move relative to the base 66*b*, and during each return stroke, the belt 66*w* revolves around the base 66*b* to eject the slice formed in the slicing stroke. A similar belt is described in U.S. Pat. No. 4,543,864, which is incorporated herein by reference.

In the preferred embodiment, the substrate 66 drops all sliced material onto the outfeed 12, which is preferably a dual-action conveyor that drives desired slices out of the central housing 14. Because of the location of the discard guide tube 68 and discard container 70 (FIG. 5), the conveyor of the outfeed 12 can be driven inwardly toward the discard guide tube 68 to discard any slices or portions of the food product that are undesirable. This is contemplated for first and last slices of some food products, such as end caps, but is not required.

The substrate 66 can alternatively be a dual-action, active conveyor that conveys slices toward one or the other of two opposite ends. Slices that drop off of one end fall onto the outfeed 12, and slices that drop off the opposite end fall into a discard guide tube 68 that directs the material to a container 70 for disposal. The alternative active substrate 66 is actuated and controlled by the computer 13 to convey the slices to any desired location.

The product holder 42 is shown in FIG. 6 with its most upstream end located adjacent, or spaced a small distance downstream from, the downstream end of the injecting conveyor 22 that is loaded with the food product 26. The product holder 42 is positioned here during loading of food product, as controlled by the computer 13. The small distance is predetermined and depends on the ability of the food product 26 to remain rigid when projected from the injecting conveyor 22. A more rigid food product can pass over a larger distance without bending substantially, and a less rigid product a smaller distance. This distance is typically no more than one inch, and no less than one-quarter of an inch, depending on the food product's characteristics.

The product holder 42 preferably has a substantially cylindrical sidewall 43 with an aperture 44 formed in the lower end thereof, as best viewed in FIG. 6, where the aperture 44 faces upstream. The sidewall 43 can be a circular cylinder, rectangular cylinder or any other cylindrical shape. The aperture 44 is spaced from the downwardly facing opening at the lower end of the product holder 42 and is separated from the downwardly facing opening by the lower panel 43*a*.

When the system is in the food product loading configuration shown in FIG. 6, the prime mover driving the injecting conveyor 22 can be actuated by the computer 13 to rapidly convey the food product along the injecting conveyor 22. When the speed of the conveyor 22 is sufficient, the food product is projected off of the injecting conveyor 22 at the downstream end into the product holder 42 through the aperture 44. The injecting conveyor 22 thus conveys the food product through the aperture 44 and into the interior of the product holder 42. Once the food product is in the product holder 42, the food product can be sliced.

The size of the aperture 44 opening is not contemplated to be the same for all products, but the size will be determined by the food product being sliced. For example, for end caps, the height of the aperture 44 can be about one or two inches to about five inches from the upper edge of the lower panel 43*a* of the sidewall 43 (see FIG. 7) to the lower edge of the upper panel 43*b*. The width of the aperture 44 is limited by the width of the product holder 42, and this can be three, four or five inches wide, or much wider. Generally, the width of the aperture 44 is the entire width of the product holder 42. Preferably, guiding panels 46 and 48 (see FIG. 7) extend at strategic angles from the product holder 42 adjacent the lateral edges of the aperture 44 and serve to "funnel" or guide any imperfectly injected food products into the product holder 42. The lower panel 43*a* has a height of about one inch, but it can vary from about one-quarter or one-half of an inch to about three inches tall.

Figure 8:
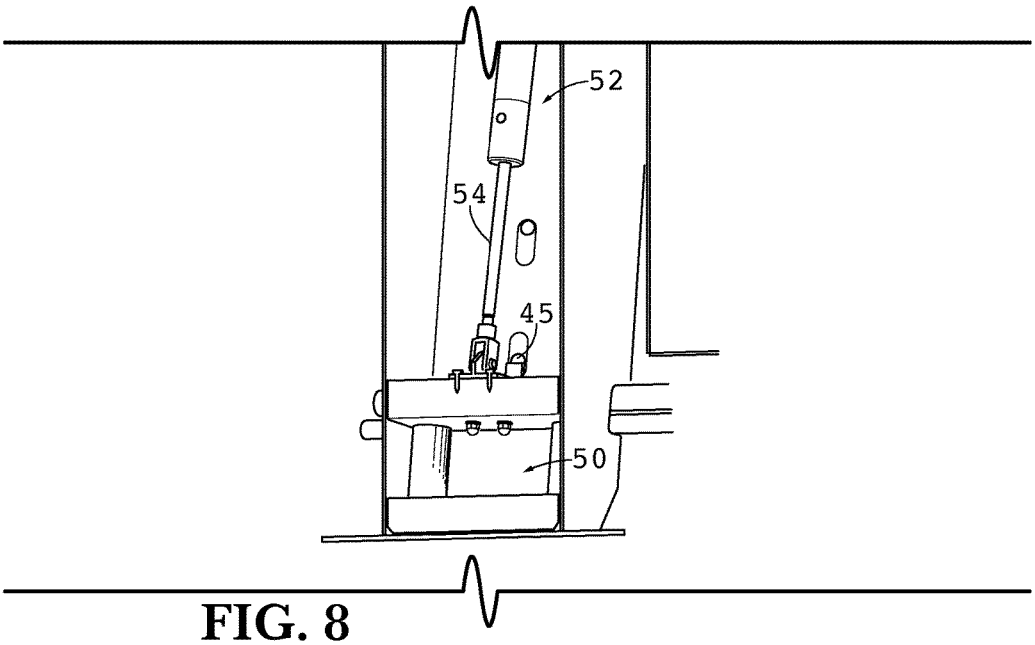
FIG. 8 is a section view in perspective illustrating the embodiment of FIG. 3 through the line 8-8.

In order to prepare the interior of the product holder 42 for the food product 26 and before the food product can be injected through the aperture 44, the weight 50, which is shown in FIG. 6 blocking the aperture 44, must be moved. The weight 50 is raised using the prime mover 52, which is preferably a pneumatic ram mounted to the inner sidewall of the product holder 42, shown best in FIG. 8. Of course, the prime mover 52 could be any other linear force providing device. The prime mover 52 is controlled by the computer 13 to raise and lower the weight 50.

The preferred weight 50 has a floor 51 and ceiling 53, along with cylindrical supports 55, and the total weight of the weight 50 is on the order of 10 pounds. Of course, the weight 50 can weigh less, such as two pounds, or more, such as 25 pounds or any amount in between, depending on the circumstances, as will be understood by the person of ordinary skill. Furthermore, the shape of the weight 50 can be modified from that shown so long as the lower end of the weight 50 has a similar outer shape and size to the interior barrel of the product holder 42 to prevent the formation of a large gap therebetween through which substantial amounts of food product being held down by the weight 50 could otherwise pass through in an upward direction. The ceiling 53 and the floor 51 preferably have outer surfaces that substantially match the inwardly facing surfaces of the sidewall 43, which mitigates any food product from bypassing the weight 50 adjacent the sidewall 43.

The ceiling 53 of the weight 50 is preferably mounted to a rod 54 of the prime mover 52. Upon actuation of the prime mover 52, the rod 54 pulls the weight 50 upwardly to an upper position in which the floor 51 is substantially above the upper edge of the sidewall that defines the aperture 44, thereby permitting the food product to be injected into the product holder 42 through the aperture 44. When the prime mover 52 is deactivated by the computer 13, the force of gravity draws the weight 50 downwardly until it rests upon the food product 26 and presses it down substantially. It is contemplated to actuate the prime mover 52 downwardly to provide additional downward force if the weight of the weight 50 is insufficient to press the food product against the thickness tray 64, or if additional force against the food product is desired. This can be controlled by the computer 13, with the need for the same detected by sensors mounted in the barrel of the product holder 42 or elsewhere. For example, if the weight 50 does not generate a sufficient downward bias to compress the food product sufficiently between the thickness tray and the weight, the prime mover 52 can be actuated to generate more than the force generated by gravitational pull on the weight 50.

As described above, the weight 50 is raised and lowered to make room for a new food product to be injected into the product holder through the aperture 44 once the previous food product exits the product holder 42 through the downwardly facing opening 49 (FIG. 6). After the food product is in the product holder 42, the weight 50 drops downward and compresses the food product during slicing. The weight 50 and the prime mover 52 are not removed from the product holder 42 during normal use, and these components substantially block any food product above them from passing by the weight 50 to the lower end of the product holder 42, or vice versa.

The weight 50 could be replaced by a structure with far less mass, by attaching a spring of any type to the sidewall 43 to bias the less massive structure downwardly against the food product. It is contemplated that if the orientation of the slicing mechanism is altered relative to the vertical orientation shown, the force of gravity would be of little assistance in forcing the weight against the food product. In this situation, any bias or linear force-generating apparatus could be used to apply a clamping force against the food product.

It is preferred that when the product holder 42 is reciprocating the food product therein through the blade 62, the lower edge of the floor 51 of the weight 50 is below the upper edge of the lower panel 43*a* in order to eliminate the possibility of the food product being ejected out of the aperture 44. However, this is not required due to the improbability of ejection in any case.

It is also contemplated to place sensors in the product holder 42 to detect the position of the weight 50, so that the position of the weight 50 can be detected and the computer 13 actuates the apparatus 8 for advantageous reasons, such as when the food product is first being sliced, and when it is close to being fully sliced. For example, the sensor 45 is attached to the rod 54 to detect the position of the rod 54. The rod 54 is mounted to the ceiling 53, which is rigidly mounted through the supports 55 to the floor 51 of the weight 50, and the lower surface of the floor 51 is a distance above the thickness tray. Once calibrated, the sensor 45 can detect the distance of the lower surface of the floor 51 above the thickness tray, which equals the thickness of the food product in the product holder. Thus, the sensor 45 can detect and signal the computer 13 regarding the thickness of food product remaining, and the computer 13 can calculate how many slices remain, including whether the remaining slices are desirable or undesirable, depending upon programmed characteristics of the food product.

It is contemplated that the computer 13 be programmed to have a particular pattern that it follows upon injection of a new food product, such as the end cap. For example, the slicing mechanism may remove the first two slices and discard them, and then slice desired slices until the thickness of the end cap is reduced to a minimum, or a predetermined number of slices is formed, as counted by the computer 13. The desired slices formed can be conveyed by the outfeed 12 for use, and then the remaining thickness of the end cap can be sliced and discarded. It is also contemplated for the remaining thickness of the end cap to be sliced very rapidly by actuating a prime mover (not shown) mounted to the thickness tray 64 to lower the thickness tray 64 substantially relative to the blade's sharp edge, thereby increasing slice thickness, and reducing the number of slices needed, to slice the remainder of the end cap rapidly. For example, if the useful slices are removed at thicknesses of about one-tenth of one inch, the waste remainder of the end cap could be sliced away at five to ten times that thickness to increase the efficiency of completing the task so the apparatus 8 can more rapidly begin to slice a new end cap. All combinations of steps that reduce waste, reduce wear, and save time are contemplated.

When the weight 50 first rests upon a newly injected food product 26 in the product holder 42, the slicing mechanism 40 is driven by its drive mechanism in a conventional manner to reciprocate the product holder 42 through a path that passes the lower edge of the food product held therein out of the downwardly facing opening 49 and into the sharp edge of the blade 62 in cyclical fashion, thereby forming slices that fall onto the substrate 66. Depending on the type of slices that are formed, the type of food product and many other variables, the first slice or two can be waste, particularly if they are formed to "square" the lower surface of the food product to the sides of the food product. The waste product can be dropped onto the outfeed 12, which, when waste slicing is completed, can drive the slices to the discard container 70, and then re-position to receive good slices. Alternatively, an active substrate can be actuated by the computer 13 to "discard" the slices by conveying them directly into the container 70, or to retain the slices by conveying them onto the outfeed 12.

One contemplated method that the computer 13 can control the apparatus 8 to carry out is that upon injection of a new food product, a predetermined number of waste slices are formed. These are discarded by any means. Then desirable slices are formed as controlled by the computer 13 for a predetermined number, weight, thickness or any other factor. Upon reaching the end of this predetermined factor, the desired slices on the outfeed 12 are advanced to allow room for the subsequent waste slices to be placed on the outfeed 12. If the factor desired to signal slicing of waste products is not predetermined, but detected, such as by the sensor 45 that detects product thickness, then the predetermined thickness can signal the computer 13 to begin a countdown of slicing the last remaining desirable slices, and then a waste slicing sequence can begin, such as after advancing the outfeed 12 to create a space for the waste slices. Then all waste can be discarded into the container, while a new food product is injected into the product holder 42. This process is repeated until all food products have been sliced.

It will become apparent from the above that loading a pendulum slicer from the front, back or side, and not from the top or bottom ends, is advantageous with the appropriate combination of features. The apparatus 8 combines an automatic loading system with a computer that controls the loading and slicing, and applies consistent pressure on the food product in the product holder so that consistent slices result. The consistent pressure is preferably a weight, so that gravity is the bias that results in consistent pressure. However, a spring-biased mechanism is also contemplated, where any known spring could be attached to the sidewall 43 and an object in the barrel that has an outer surface that substantially corresponds to the barrel's inner surface.

The apparatus 8 preferably detects that a load of food product in the product holder 42 has been sliced through, such as by sensing the amount of food product in the product holder, by counting the slices or by any other means. The apparatus 8 also releases the mechanism applying downward (in the orientation of FIG. 2) pressure to the food in the product holder 42, automatically transfers food product from the injecting conveyor 22 to the interior of the product holder 42, and automatically re-engages pressure on the food product followed by a continuation of slicing. Then the process repeats.

It is also contemplated to detect that a sufficient amount (weight, thickness, etc.) of food product in the product holder has been sliced through, such as by using sensors signaling the computer 13 using software that analyzes the signals for passing a predetermined threshold. This allows the apparatus 8 to conclude that the remaining food product in the product holder will not yield the desired quality of finished slices and automatically reject the remaining portion of the food product.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A food product slicer comprising:

(a) a product holder including an elongated, tubular sidewall defining a longitudinal barrel that the sidewall encircles, the sidewall extending vertically and having a first barrel opening at a first sidewall end disposed adjacent a blade, wherein the product holder is configured to be driven cyclically along a path in which the product holder reaches a first path end and in which the first barrel opening passes adjacent the blade to slice a food product that is in the barrel;

(b) a horizontally-facing aperture extending through only a portion of a length of the sidewall near the first sidewall end, and being large enough for the food product to be inserted through the aperture;

(c) an object disposed within the barrel adjacent the aperture during movement of the product holder through the path for bearing against the food product, the object having an outer shape that corresponds to the barrel;

(d) a prime mover drivingly linked to the object to drive the object along the barrel at least away from the first barrel opening;

(e) a food product injector disposed horizontally-adjacent the first path end, the injector having a surface upon which the food product is supported before the food product injector injects the food product horizontally over a gap between the injector and the sidewall through the aperture into the barrel; and (f) a central computer that controls movement of the product holder and the food product injector, wherein the central computer limits the food product to being injected through the aperture when the aperture is disposed adjacent the first path end.

2. The food product slicer in accordance with claim 1, further comprising:

(a) a first conveyor disposed upstream of the aperture, wherein a downstream end of the first conveyor is disposed, in an operable position, upstream of an upstream end of the food product injector, and a downstream end of the food product injector is disposed upstream of the aperture.

3. A food product slicer comprising:

(a) a product holder having an elongated, tubular sidewall defining a longitudinal barrel that the sidewall encircles, the sidewall extending vertically and having a lower sidewall end with a downwardly-facing barrel opening mounted, in an operable position, above a blade disposed adjacent a thickness tray, the product holder configured to be driven reciprocatingly through an arcuate path in which the lower sidewall end passes above the blade while the barrel opening faces the thickness tray, and in which the product holder reaches a first path end;

(b) a horizontally-facing aperture extending through the sidewall adjacent the lower sidewall end and spaced from the barrel opening, the aperture interposed along a length of the sidewall between an upper sidewall panel and a lower sidewall panel, the lower sidewall panel extending from the lower sidewall end to the aperture at least during movement of the product holder through the path, the upper sidewall panel extending upwardly from the aperture at least during movement of the product holder through the path;

(c) a weight disposed within the barrel adjacent the aperture during movement of the product holder through the path for bearing downwardly toward the barrel opening against a food product to clamp the food product between the weight and the thickness tray;

(d) a prime mover drivingly linked to the weight for moving the weight at least upwardly from an aperture-blocking position to an aperture-exposing position;

(e) an injecting conveyor disposed horizontally-adjacent the first path end, the injecting conveyor having a surface upon which the food product is supported before the injecting conveyor injects the food product horizontally over a gap between the injecting conveyor and the sidewall through the aperture into the barrel when the aperture is disposed adjacent the first path end; and (f) a computer that controls an operation of the injecting conveyor in response to a position of the product holder.

4. The food product slicer in accordance with claim 3, further comprising:

(a) a first conveyor disposed upstream of the aperture, wherein a downstream end of the first conveyor is disposed upstream of above an upstream end of the injecting conveyor, and a downstream end of the injecting conveyor is disposed upstream of the aperture during at least a portion of the path.

5. The food product slicer in accordance with claim 4, further comprising a third conveyor disposed beneath the weight to receive slices of the food product, wherein the third conveyor is actuated by the computer to convey the slices in a first direction or in an opposite, second direction.

6. A food product slicer comprising:

(a) a product holder including an elongated, tubular sidewall defining a longitudinal barrel that the sidewall encircles, the sidewall extending vertically and having a first barrel opening at a first sidewall end disposed adjacent a blade, wherein the product holder is configured to be driven cyclically along a path in which the product holder reaches a first path end and in which the first barrel opening passes adjacent the blade to slice a food product that is in the barrel;

(b) a horizontally-facing aperture extending through only a portion of a length of the sidewall near the first sidewall end, and being large enough for the food product to be inserted through the aperture;

(c) an object disposed within the barrel adjacent the aperture for bearing against the food product, the object having an outer shape that corresponds to the barrel;

(d) a prime mover drivingly linked to the object to drive the object along the barrel at least away from the first barrel opening;

(e) a food product injector disposed horizontally-adjacent the first path end, the injector having a surface upon which the food product is supported before the food product injector injects the food product horizontally over a gap between the injector and the sidewall through the aperture into the barrel when the aperture is disposed adjacent the first path end; and (f) a computer that controls an operation of the food product injector in response to a position of the product holder.

* * * * *